US009131822B1

(12) United States Patent
Zara

(10) Patent No.: US 9,131,822 B1
(45) Date of Patent: Sep. 15, 2015

(54) CANTILEVERED CLEANING DEVICE

(76) Inventor: Anthony Zara, Columbus, OH (US)

( * ) Notice: Subject to any disclaimer, the term of this patent is extended or adjusted under 35 U.S.C. 154(b) by 441 days.

(21) Appl. No.: 13/086,488

(22) Filed: Apr. 14, 2011

(51) Int. Cl.

| | |
|---|---|
| ***A47L 13/20*** | (2006.01) |
| ***A47L 13/46*** | (2006.01) |
| ***A47L 13/10*** | (2006.01) |
| ***A47L 13/16*** | (2006.01) |

(52) U.S. Cl.
CPC *A47L 13/16* (2013.01); *A47L 13/46* (2013.01)

(58) Field of Classification Search
CPC ..... A47L 13/25; A47L 13/256; A47L 13/12; A47L 13/16; A47L 13/258; A47L 11/4041
USPC ..... 15/228, 120.1, 244.2, 231, 104.94, 15/210.1, 244.1, 220.3
See application file for complete search history.

(56) References Cited

U.S. PATENT DOCUMENTS

| | | | | |
|---|---|---|---|---|
| 861,867 | A | 7/1907 | Lefevre | |
| 1,047,021 | A | 12/1912 | Farnum | |
| 1,291,131 | A | 1/1919 | Radel | |
| 2,743,471 | A | 5/1956 | Forrester | |
| 2,873,462 | A | 2/1959 | Green | |
| 3,525,113 | A * | 8/1970 | Leland | 15/229.4 |
| 3,699,603 | A * | 10/1972 | Popeil | 15/120.1 |
| 3,750,220 | A * | 8/1973 | Popeil et al. | 15/228 |
| 4,047,260 | A | 9/1977 | Deutsch et al. | |
| 4,769,869 | A | 9/1988 | Benitez | |
| 5,343,587 | A | 9/1994 | Findley | |
| 5,471,703 | A | 12/1995 | Niven | |
| 5,655,250 | A | 8/1997 | Warrell | |
| 5,924,157 | A | 7/1999 | Barela | |
| 6,405,403 | B1 | 6/2002 | McKay | |
| 7,281,288 | B1 * | 10/2007 | McKay | 15/144.2 |
| 2004/0205921 | A1 * | 10/2004 | Woodruff et al. | 15/230.11 |
| 2006/0130261 | A1 * | 6/2006 | Futo et al. | 15/230.11 |

FOREIGN PATENT DOCUMENTS

| | | | |
|---|---|---|---|
| CN | 1537504 | A | 10/2004 |

OTHER PUBLICATIONS http://www.cubanfoodmarket.com/mm5/merchant.mvc?Screen=PROD&Product_Code=MOPSET&Category_Code=. Cuban Food Market.com Cuban Mop Set—2 Free Mop Cloths. Web page accessed Jan. 24, 2011.

http://www.cubanfoodmarket.com/mm5/merchant.mvc?Screen=PROD&Product_Code=MOP-1&Category_Code=. Cuban Food Market.com Wood Cuban Mop with 1 Free Mop Cloth. Web page accessed Jan. 24, 2011.

3 images detailing an Unger brand Microfiber Ceiling Fan Duster, which includes a sewn microfiber sock and a wire frame with a handle adapter.

* cited by examiner

*Primary Examiner* — Monica Carter
*Assistant Examiner* — Stephanie Berry
(74) *Attorney, Agent, or Firm* — James R. Eley; Claire Patton; Eley Law Firm Co., LPA

(57) ABSTRACT

A cleaning device has a frame with a generally U-shaped member. The U-shaped member has a first leg forming an applicator portion. A second leg of the U-shaped member is spaced apart from the first leg and forms an arm. A fabric retainer is proximate the applicator portion. The applicator portion is cantilevered from the frame.

11 Claims, 6 Drawing Sheets

CANTILEVERED CLEANING DEVICE

FIELD

The present invention relates generally to cleaning devices, in particular to a cleaning device having a cantilevered applicator portion configured to receive a removable fabric piece.

BACKGROUND

Many of the prior developments in the art of cleaning devices have been directed towards convenience. As a result, many mop heads are wholly disposable or are comprised of disposable cleaning sheets that are used and then detached from the mop and replaced. These cleaning sheets are often proprietary and are sometimes pre-impregnated with cleaning solutions.

While disposable cleaning sheets are convenient for the user they are not always the most efficient means of cleaning. For example, proprietary materials limit the flexibility of prior devices to utilize alternate types of cleaning materials. In addition, disposable materials create waste and may have long-term environmental consequences. Often times these devices are simply inadequate for the cleaning task at hand. Cleaning efficiency is thus sacrificed for the perceived convenience of the device, and the user often finds oneself scrubbing the area by hand; perhaps on hands and knees, using a rag and a favorite cleaning compound.

Most cleaning devices are also disadvantaged in the cleaning of both floors and overhead surfaces, usually being generally designed for one or the other. For example, a floor mop is often a poor choice for cleaning dust from the top surface of the blades of an overhead fan.

Two attempts to solve some of these problems in the prior art may be found in U.S. Pat. No. 3,699,603 to Popeil and U.S. Pat. No. 5,343,587 to Findley. The embodiments described by Popeil include a cantilevered mop head capable of cleaning both floor surfaces and overhead surfaces; however the incorporation of a mechanical sponge wringer in the head may have encumbered the device and complicated its use, thereby limiting its convenience and commercial success. It is notoriously difficult to control the amount of moisture in a wet sponge mop, making them messy for overhead use. Wet sponges also absorb bacteria, abrasive grit, and odors that can hamper the efficiency of a device. Foam sponges have the further problem of decomposing unevenly and allowing hard or abrasive support materials to contact the cleaning surface. Popeil recognizes some of the problems introduced by sponge cleaning devices and attempts to remedy some of these issues in a preferred embodiment by wrapping the sponge in a removable cloth sleeve that could be later laundered, however since the sponge is the main means to transfer both pressure and cleaning solution to and from the surface the underlying problems still remain.

The embodiments described by Findley include a "T" shape for pushing a cloth on a cleaning surface. The device is limited to fabrics that can be constructed with loops incorporated in the material that can be held in place by Velcro hook material. The simple rigid inverted "T" shape mop has long been known in the prior art under the folk name "Cuban Mop." It is used primarily to push a wet or dry rag on the surface to be cleaned while the user is in a standing position, but incorporates no convenient means to hold a cloth on the "T." The "T" shape provides substantial benefits to the user in that the user can use such cleaning materials as they find convenient, pushing them from standing. Findley is an improvement over the prior art in that it provides a means to attach the cloth to the "T," which allows more control by the user. However, the limitations in the type of cloth that can be attached makes the improvement a minor one and may not be worth the additional cost and complexity.

SUMMARY

The present invention relates to an improved surface cleaning device with a simple and economical method of construction. It is an object of the invention that a user may use the device to clean surfaces ranging broadly from mopping floors to cleaning overhead surfaces with a wide variety of wet or dry fabric cloth materials. Common cloth materials are easily and detachably affixed to the device such that they do not have to be cut or altered to be used in the device. Once they have been used, the cloth materials may be removed and disposed of or laundered for reuse.

Cloth materials may range from ordinary household towels or rags such as discarded clothing, to microfiber cloths, nonwoven fabrics, paper products, and any other suitable cleaning materials that may be held in the frame of the device.

It is contemplated that some embodiments of the device may take advantage of advancements in computer numerical control (CNC) machine tools and wire-forming for economical construction.

According to one embodiment the present invention is a cleaning device. The cleaning device has a frame with a generally U-shaped member. The U-shaped member has a first leg forming an applicator portion. A second leg is spaced apart from the first leg and forms an arm. A fabric retainer is proximate the applicator portion. The applicator portion is cantilevered from the frame. The applicator portion is configured to apply a force, through a fabric, against a surface to be cleaned.

According to another embodiment of the present invention a cleaning device comprises a unitary frame formed from a metal rod. The frame includes a helically-wound handle connector. An arm extends from a first end of the handle connector. A first fabric retainer is formed at a distal end of the arm and comprises closely-adjacent frame portions configured to pinch or clamp a fabric. An applicator portion extends from the fabric retainer. The arm, fabric retainer and applicator portion form a generally U-shaped member. A generally cylindrical applicator sheath has a receptacle, the receptacle being coupled to the applicator portion of the frame, the applicator sheath further being cantilevered from the frame. A handle is threadably received by the handle connector.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
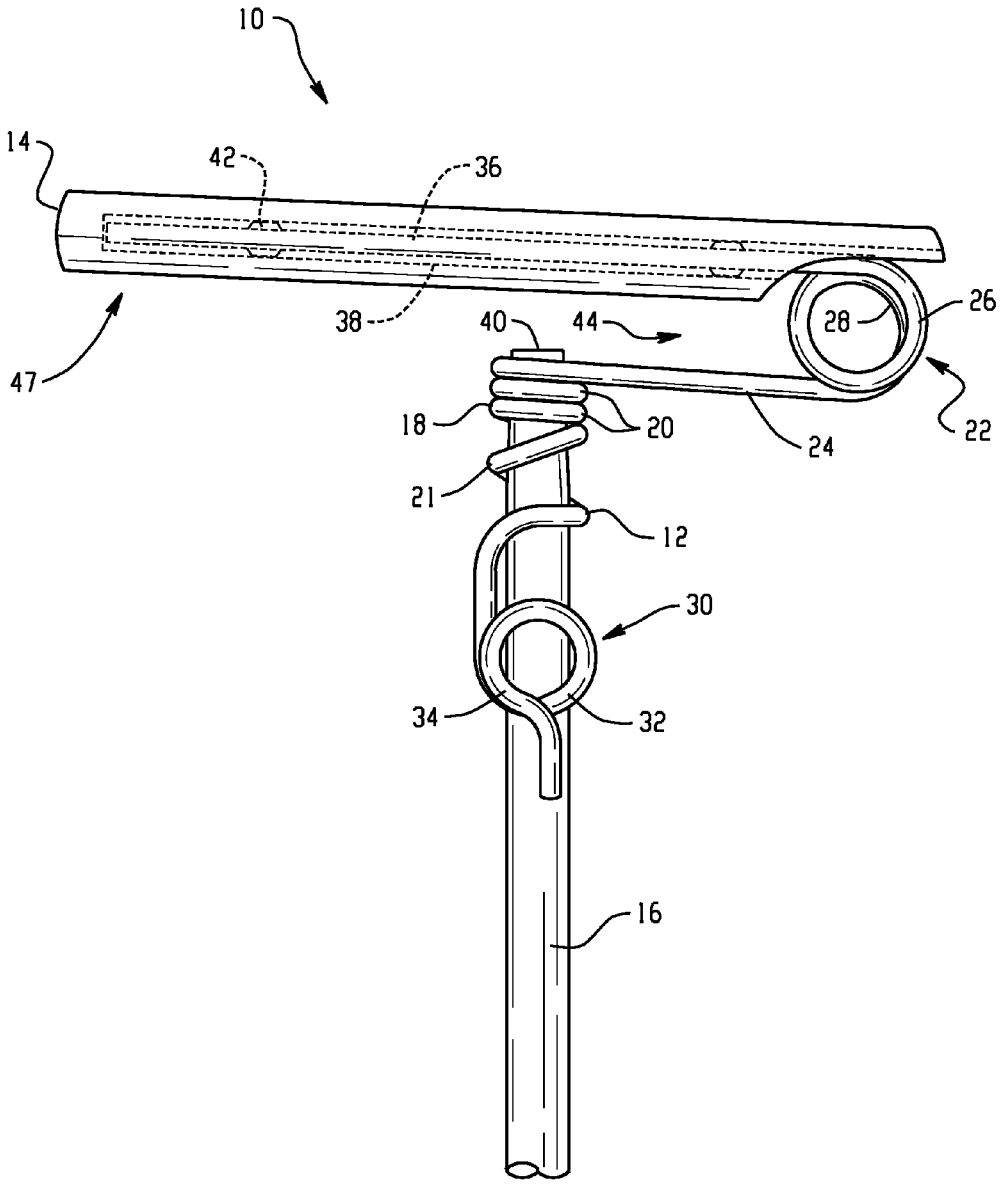
FIG. 1 is a front elevational view of a cantilevered cleaning device according to an embodiment of the present invention.
Figure 2:
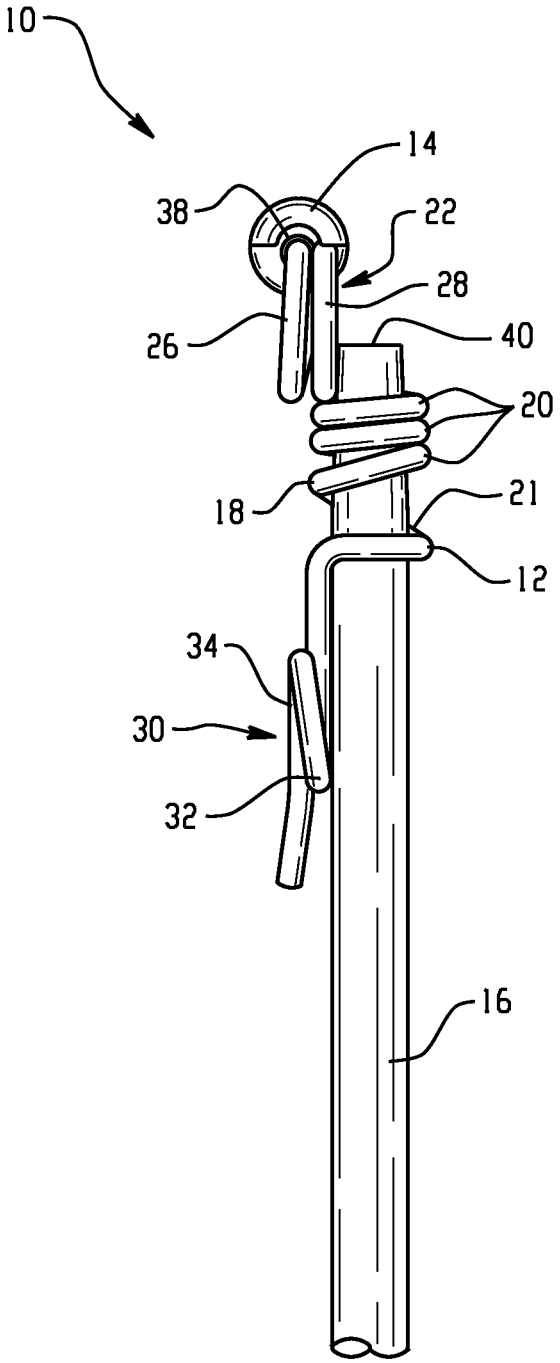
FIG. 2 is a side elevational view of the cantilevered cleaning device of FIG. 1.

In the discussion that follows, like reference numerals are used to describe like elements in the various figures and embodiments. Furthermore, the elements in the various figures are not necessarily to scale.

The general arrangement of a cantilevered cleaning device 10 is shown in FIGS. 1 through 4 according to an embodiment of the present invention. Cleaning device 10 includes a frame 12, an applicator sheath 14 and a handle 16.

Frame 12 includes a handle connector 18 sized and shaped to receive handle 16. In one embodiment handle connector 18 comprises a plurality of formed, helically-wound, open coils 20 having a suitable inner diameter that conforms to a standard broomstick thread, forming a connector. Handle connector 18 may be sized and shaped to threadably receive a wide array of both standard handles and telescopic or adjustable handles. Handle connector 18 may further include a spiraling handle support member 21 for increased durability or robustness of the connection between the handle connector and the handle 16 coupled thereto. The support provided by handle connector 18 allows for the use of less expensive unreinforced common broomsticks, while the use of standard thread sizes allows for use of a variety of standard or telescopic handles that are common in the marketplace. In alternative embodiments handle 16 may be coupled to frame 12 by other means such as, but not limited to, brazing, an interference fit, gluing and molding.

Frame 12 also includes a first fabric retainer 22 spaced apart from a first end of handle connector 18 by an arm 24. First fabric retainer 22 comprises a pair of closely-adjacent frame portions, such as open coils 26, 28, for pinching or clamping a fabric, as detailed further below.

In some embodiments of the present invention a second fabric retainer 30 may extend from a second, opposing end of handle connector 18. Second fabric retainer 30 comprises a pair of closely-adjacent frame portions, such as open coils 32, 34, for pinching or clamping a fabric, as detailed further below.

Frame 12 may be formed from a single metallic rod through a process of CNC wire forming, of which recent advancements in the art have increased production speed and reduced the need for specialized tooling, to form complex bends of metal rod in multiple planes. In alternative embodiments frame 12 may also be formed via a multi-form automated wire-forming process. In still other embodiments frame 12 may also be cast, extruded, or molded of suitable metallic or non-metallic materials. Frame 12 may be finished in any conventional manner, such as painting, coating, plating, molded-in colors and decorative features, or may be left unfinished.

Applicator sheath 14 is a generally cylindrical member coupled to and extending from first fabric retainer 22. In one embodiment an applicator portion 36, comprising a formed rod portion projecting from first fabric retainer 22, is inserted into a receptacle 38 of applicator sheath 14 to couple the applicator sheath to the fabric retainer. Applicator portion 36 may be inserted into receptacle 38 with an interference fit such that a mechanical holding force is obtained. The holding force between applicator sheath 14 and applicator portion 36 may be increased with the addition of small flanges 42 extending from applicator portion 36, glue, or otherwise barbing applicator portion 36 so that it is securely joined to applicator sheath 14.

Figure 6:
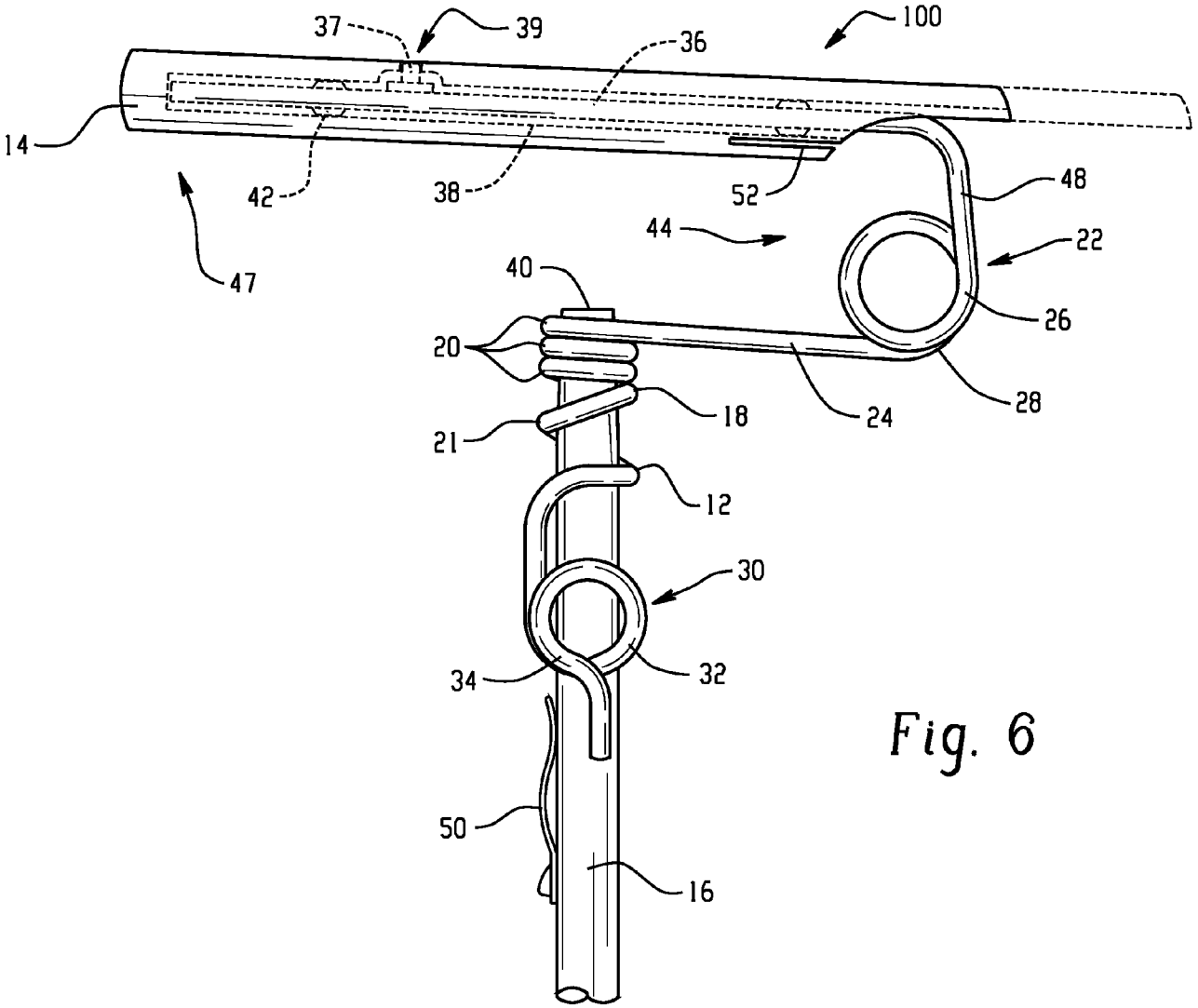
FIG. 6 is a front elevational view showing a cantilevered cleaning device according to several alternate embodiments of the present invention.

With reference to FIG. 6, in other embodiments of the present invention applicator portion 36 may include a "button" or other projecting member 37 that is biased away from the applicator portion. When applicator sheath 14 is coupled to applicator portion 36 the projecting member 37 is urged into an aperture 39 of the applicator sheath, securing the applicator sheath to the applicator portion. Applicator sheath 14 may subsequently be detached from applicator portion 36 by pressing against the projecting member 37 with sufficient force to overcome its bias, urging it out of the aperture 39. In this state applicator sheath 14 may be separated from applicator portion 36.

In yet other embodiments of the present invention applicator portion 36 and applicator sheath 14 may be threadably coupled together.

Applicator sheath 14 may be made from any material suitable for the expected use and environment including, without limitation, wood, metal, plastic, fiberglass and composites. In addition, applicator sheath 14 may be formed in any conventional manner including, but not limited to, carving, milling, casting, machining, forming, molding and stamping. Furthermore, applicator sheath 14 may be finished in any conventional manner, such as painting, coating, plating, molded-in colors and decorative features, or may be left unfinished. In one embodiment applicator sheath 14 is a substantially cylindrical wooden dowel coated with a water and chemical resistant coating.

Handle 16 is generally cylindrical and of a predetermined length for ease of use of cleaning device 10. A first end 40 of handle 16 may be sized or tapered to be received by handle connector 18. In some embodiments first end 40 is threaded with a standard three-quarter inch diameter, five threads per inch "Acme" form threads and is threadably received by handle connector 18, though in other embodiments other sizes or proprietary configurations may be used. In alternative embodiments handle 16 may be attached to frame 12 by other means such as, but not limited to, brazing, an interference fit, gluing and molding.

Handle 16 may be made from any material suitable for the expected use and environment for cleaning device 10 including, without limitation, wood, metal, plastic and composites. In addition, handle 16 may be formed in any conventional manner including, but not limited to, carving, milling, casting, machining, forming, molding and stamping. Furthermore, handle 16 may be finished in any conventional manner, such as painting, coating, plating, molded-in colors and decorative features, or may be left unfinished.

Cleaning device 10 is assembled by coupling applicator sheath 14 to frame 12, inserting applicator portion 36 of the frame into receptacle 38 of the applicator sheath. In addition, handle 16 is assembled to frame 12 by coupling first end 40 of the handle to handle connector 18 of the frame. In its assembled state cleaning device 10 includes a generally U-shaped, cantilever member 44 with a first leg of the "U" comprising applicator portion 36. A second leg of the "U" of member 44 comprises arm 24, which is generally parallel to applicator portion 36. These first and second legs of member 44 are spaced apart by first fabric retainer 22, which is joined to arm 24 and applicator portion 36.

The cantilever formed by member 44 allows for draping of a variety of shapes of fabric 46 about applicator sheath 14. Member 44 is preferably generally rigid, yet capable of allowing some flexure when a force is applied between applicator sheath 14 and handle 16.

Figure 3:
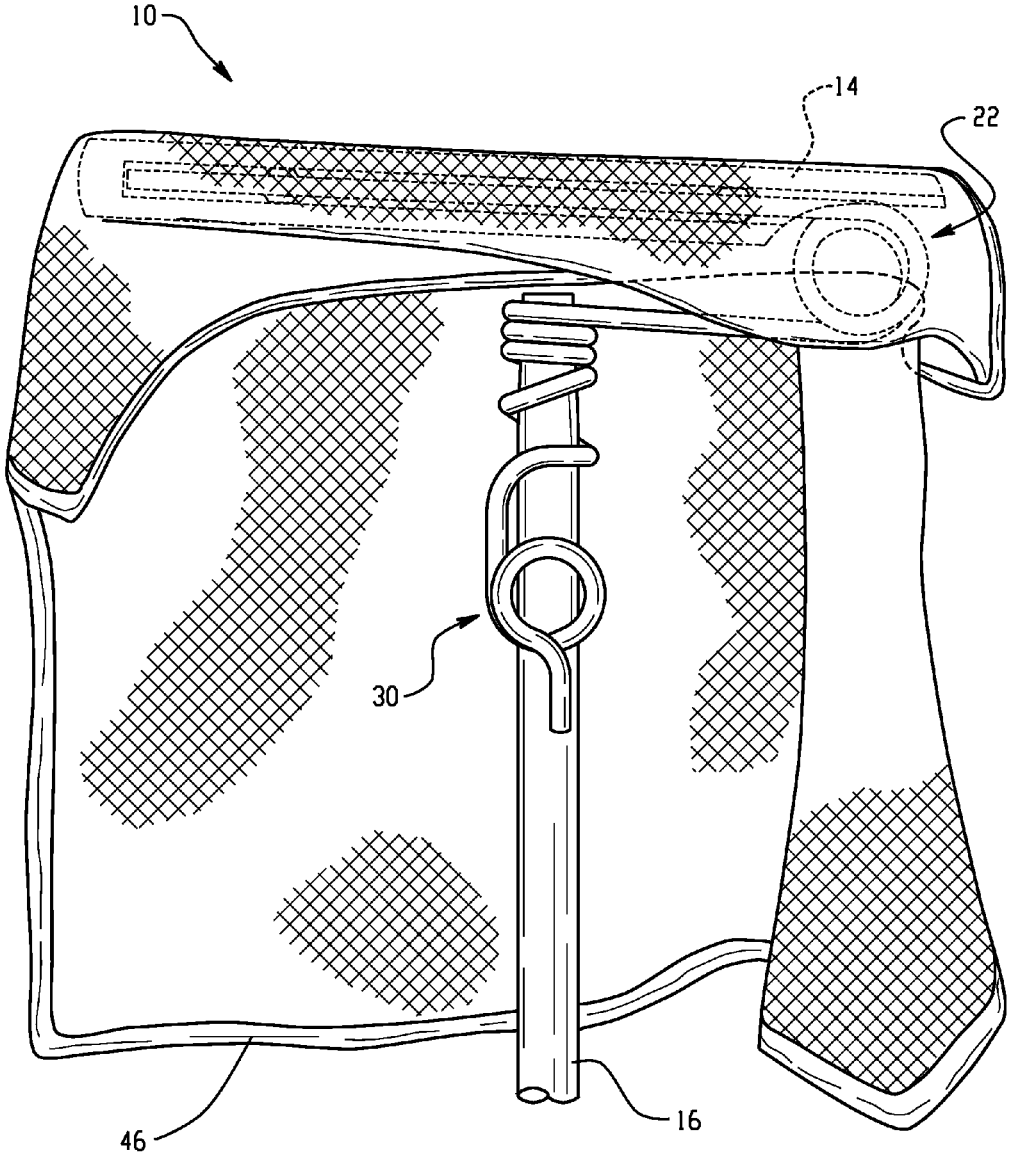
FIG. 3 is a front elevational view showing the cantilevered cleaning device of FIG. 1 with a cleaning cloth attached according to an embodiment of the present invention.
Figure 4:
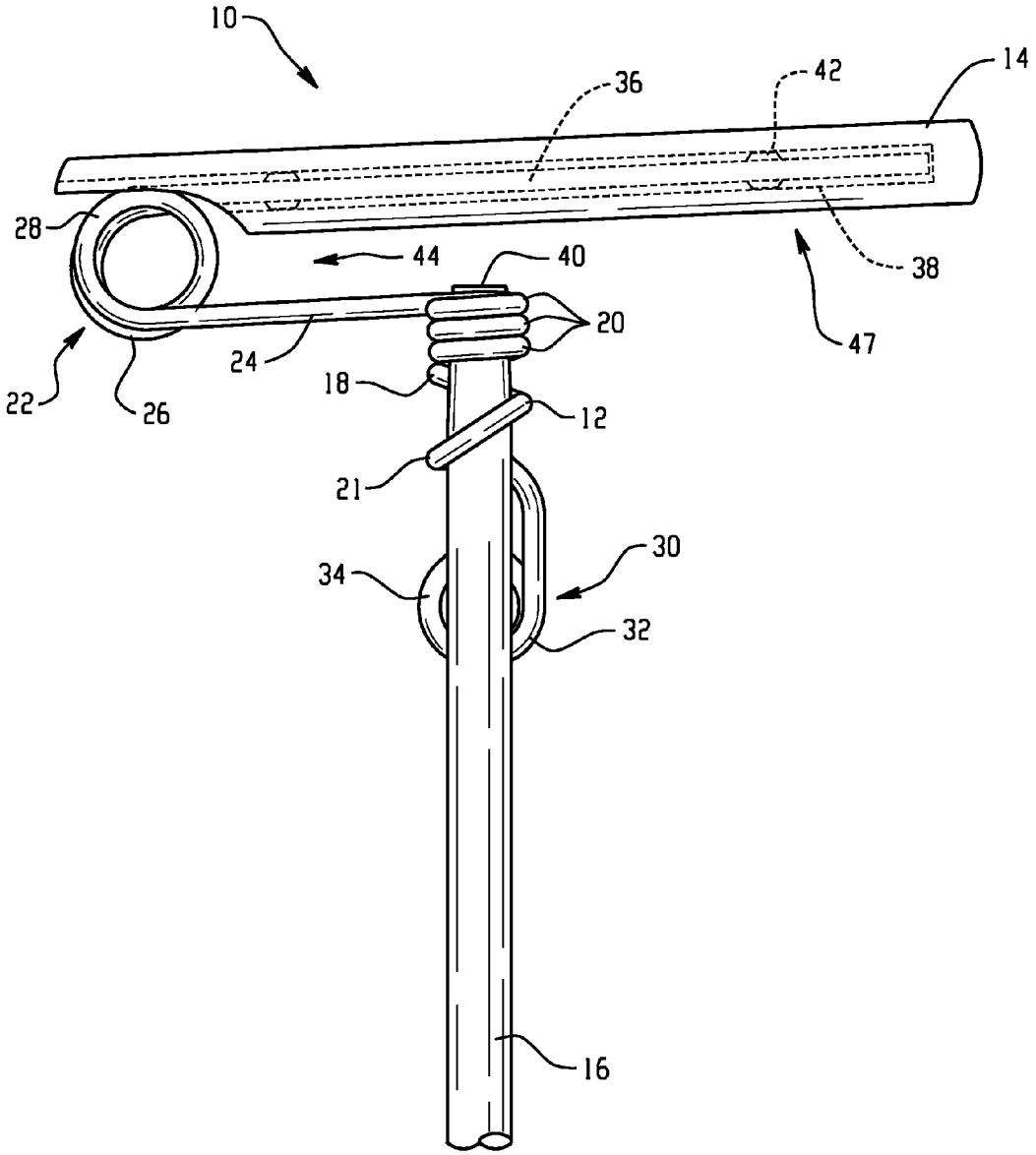
FIG. 4 is a rear elevational view of the cantilevered cleaning device of FIG. 1.
Figure 5:
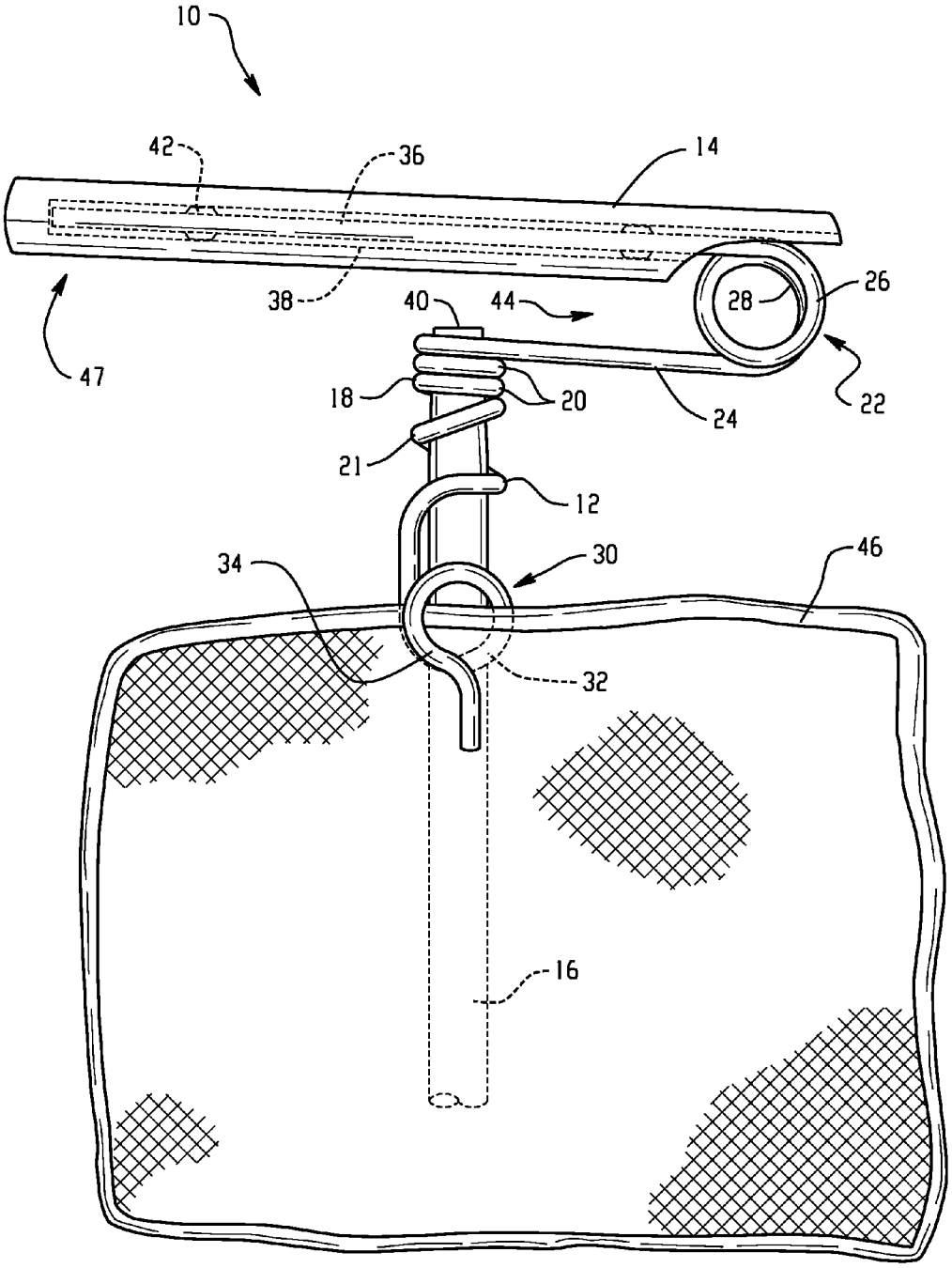
FIG. 5 is a front elevational view of the cantilevered cleaning device of FIG. 1 with a cleaning cloth attached according to another embodiment of the present invention.

With particular reference to FIG. 3, in use a select fabric 46 is coupled to first fabric retainer 22 by urging the fabric between the coils 26, 28 such that the coils pinch and selectably retain the fabric. Alternatively, with reference to FIG. 5, a fabric 46 may be coupled to second fabric retainer 30 by urging the fabric between the coils 32, 34 such that the coils pinch and selectably retain the fabric. The fabric is draped over applicator sheath 14. Applicator sheath 14 is a work-surface and provides a convenient draping surface for fabric 46, allowing the fabric to be re-positioned during use of cleaning device 10 to move soiled areas of the cloth away from a surface to be cleaned, better utilizing the whole cloth in cleaning.

Grasping handle 16, the user may slidably move fabric 46, which is draped over applicator sheath 14 in the manner described above, over a surface to be cleaned. For example, fabric 46 may be used for dusting or wet-mopping a floor. The cantilevered applicator sheath 14 and U-shaped member 44 cooperate to facilitate convenient cleaning of overhead surfaces such as door tops, over head fan blades, shelf tops, and many other surfaces with fabric 46. For example, cantilevered applicator sheath 14 is oriented generally orthogonally to handle 16 with a distal portion 47 of the applicator sheath projecting outwardly, allowing the distal portion to reach and clean horizontal overhead surfaces such as door tops and exposed molding. Cleaning device 10 is particularly suited for cleaning overhead fan blades, as the blades can fit into the space delimited by U-shaped member 44, allowing fabric 46 to slide along the top surface of the blade.

With applicator sheath 14 in contact with a surface to be cleaned, the user may urge handle 16 toward or away from applicator sheath 14. The resulting flexure of the U-shaped member 44 may be felt through handle 16 by the user, providing feedback to the user about the work-surface. In addition, flexure of U-shaped member 44 may cushion or modulate the force applied by the user as the fabric 46-covered applicator sheath 14 travels over the work-surface, to protect delicate surfaces from marring.

Fabric 46 may be any type of material suitable for use with cleaning device 10. Fabric 46 may be, without limitation, purpose-made cloths of predetermined sizes and shapes, rags, towels, wipes, absorbent materials, microfiber and viscose fabric. Fabric 46 may be in a wet or a dry condition. If wet, fabric 46 may be wetted with water or a suitable cleaning solution. In some embodiments fabric 46 may be pre-impregnated with a suitable cleaning chemical such as those commonly provided for use with quick mops.

With reference again to FIG. 6, in an alternative embodiment of the present invention a cantilevered cleaning device 100 has an offset 48 interposed between first fabric retainer 22 and applicator portion 36 to provide a greater clearance between arm 24 and the applicator portion. Frame 12 may be modified in this or any other manner and may incorporate more complex forms within the scope of the invention while still including cantilevered U-shaped member 44.

In some embodiments of the present invention applicator sheath 14 may be selectably detachable from applicator portion 36, thereby allowing for the interchangeable use of special-purpose applicator sheaths. Such special-purpose applicator sheaths may be sized and shaped for applying force to the work surface, carrying on-board cleaning solutions within the applicator sheath, may be a type of specialized cleaning head made of materials designed for specific cleaning purposes such as a shaped brush or sponge. Another type of special-purpose cleaning head is a roller having an exposed adhesive for attracting dust, dirt and lint.

It should be noted that cleaning device 10 may be utilized without an applicator sheath 14 coupled thereto. When configured in this manner applicator portion 36 may be configured such that applicator sheath 14 is selectably attached and detached from the applicator portion, allowing the applicator sheath to be included or omitted from cleaning device 10 as desired by the user. Alternatively, applicator portion 36 may be formed having a size and shape similar to that of applicator sheath 14, obviating the need for a separate applicator sheath. When cleaning device 10 is utilized without an applicator sheath 14 a user may slidably move a fabric 46, which is draped directly over applicator portion 36, over a surface to be cleaned.

With general reference to FIG. 6, in still other alternate embodiments of the present invention other forms of mechanical clamping such as biased or non-biased clips 50 may be used to retain fabric 46 to cleaning device 10. In yet other alternate embodiments applicator sheath 14 may include a fabric retainer 52, such as pinch points formed by one or more cuts or slits in the applicator sheath.

While this invention has been shown and described with respect to a detailed embodiment thereof, it will be understood by those skilled in the art that changes in form and detail thereof may be made without departing from the scope of the claims of the invention. For example, open coils 26, 28 and 30, 32 may be substituted with any closely-adjacent frame portions arranged to form pinch points for selectably retaining a fabric 46.

What is claimed is:

1. A cleaning device, comprising:

a unitary frame formed from a metal rod, the frame including:

a helically-wound handle connector, an arm extending from a first end of the handle connector, a first fabric retainer formed at a distal end of the arm, the first fabric retainer comprising closely-adjacent frame portions configured to pinch or clamp a fabric to the frame, and an applicator portion extending from the fabric retainer, the arm, fabric retainer and applicator portion forming a generally U-shaped member;

a generally cylindrical applicator sheath having a receptacle, the receptacle being coupled to the applicator portion of the frame, the applicator sheath further being cantilevered from the frame; and a handle threadably received by the handle connector.

2. The cleaning device of claim 1, further including a second fabric retainer extending from a second, opposing end of the handle connector.

3. A method for making a cleaning device, comprising the steps of:

obtaining a unitary frame formed from a metal rod, the frame having a generally U-shaped member, the U-shaped member having a first leg forming an applicator portion and a second leg spaced apart from the first leg;

forming an arm from the second leg of the U-shaped member;

forming a fabric retainer integral with the frame intermediate the applicator portion and the arm;

forming closely-adjacent frame portions in the fabric retainer, the frame portions being configured to pinch or clamp a fabric to the frame, the applicator portion being cantilevered from the frame;

forming a helically-wound handle connector, the arm extending from a first end of the handle connector;

obtaining a generally cylindrical applicator sheath having a receptacle; and coupling the receptacle to the applicator portion of the frame, the applicator sheath further being cantilevered from the frame.

4. The cleaning device of claim 3 wherein the first fabric retainer comprises open coils; and the first fabric retainer is interposed between the arm and the applicator portion.

5. The cleaning device of claim 1 wherein the applicator sheath is a cylindrical rod.

6. The cleaning device of claim 1 wherein the applicator portion further includes flanges or barbs.

7. The cleaning device of claim 1 wherein the handle connector further includes a handle support member.

8. The cleaning device of claim 1, further including a fabric retainer clip.

9. The cleaning device of claim 1 wherein the first fabric retainer comprises open coils formed as a unitary portion of the frame.

10. The cleaning device of claim 9 wherein the second fabric retainer comprises closely-adjacent frame portions configured to pinch or clamp a fabric.

11. The cleaning device of claim 10 wherein the second fabric retainer comprises open coils formed as a unitary portion of the frame.

* * * * *